US008620533B2

(12) United States Patent
Taylor

(10) Patent No.: US 8,620,533 B2
(45) Date of Patent: Dec. 31, 2013

(54) SYSTEMS, METHODS, AND DEVICES FOR CONTROLLING A MOVEMENT OF A DIPPER

(75) Inventor: Wesley P. Taylor, Glendale, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 314 days.

(21) Appl. No.: 13/220,864

(22) Filed: Aug. 30, 2011

(65) Prior Publication Data

US 2013/0051963 A1 Feb. 28, 2013

(51) Int. Cl.
*G06F 7/70* (2006.01)
*E02F 5/02* (2006.01)

(52) U.S. Cl.
USPC ..... 701/50; 37/348

(58) Field of Classification Search
USPC ..... 37/347, 348, 466, 468, 395–399; 414/690, 718, 728; 172/2–11; 701/50
See application file for complete search history.

(56) References Cited

U.S. PATENT DOCUMENTS

| | | | |
|---|---|---|---|
| 3,642,159 | A | 2/1972 | Askins |
| 5,442,868 | A | 8/1995 | Ahn |
| 5,493,798 | A | 2/1996 | Rocke et al. |
| 5,528,498 | A | 6/1996 | Scholl |
| 5,548,516 | A | 8/1996 | Gudat et al. |
| 5,748,097 | A | 5/1998 | Collins |
| 5,908,458 | A | 6/1999 | Rowe et al. |
| 5,953,977 | A | 9/1999 | Krishna et al. |
| 5,978,504 | A | 11/1999 | Leger |
| 6,058,344 | A | 5/2000 | Rowe et al. |
| 6,076,030 | A | 6/2000 | Rowe |
| 6,085,583 | A | 7/2000 | Cannon et al. |
| 6,108,949 | A | 8/2000 | Singh et al. |
| 6,167,336 | A | 12/2000 | Singh et al. |
| 6,223,110 | B1 | 4/2001 | Rowe et al. |
| 6,247,538 | B1 | 6/2001 | Takeda et al. |
| 6,317,669 | B1 | 11/2001 | Kurenuma et al. |
| 6,336,077 | B1 | 1/2002 | Boucher |

(Continued)

FOREIGN PATENT DOCUMENTS

| | | |
|---|---|---|
| DE | 19856610 | 6/1999 |
| JP | 2000192514 | 7/2000 |

(Continued)

OTHER PUBLICATIONS

Winstanley, Graeme et al., Dragline Automation—A Decade of Development, IEEE Robotics & Automation Magazine, Sep. 2007, p. 52-64.

*Primary Examiner* — Robert Pezzuto
(74) *Attorney, Agent, or Firm* — Michael Best & Friedrich LLP

(57) ABSTRACT

Systems, methods, and devices for controlling an industrial machine. The industrial machine includes, for example, a dipper, a boom, a hoist motor, a crowd motor, one or more operator control devices, and a controller. The control devices are configured to be manually controllable by an operator of the industrial machine. The controller receives an output signal associated with a desired movement of the dipper, receives a signal associated with a hoist motor characteristic, and receives a signal associated with a crowd motor characteristic. The controller determines a present position of the dipper with respect to a boom profile, determines a first future position of the dipper with respect to the boom profile and based on the output signal from the operator control devices, and automatically controls a movement of the dipper with respect to the boom profile when the first future position of the dipper approximately corresponds to a boom profile limit.

16 Claims, 6 Drawing Sheets

(56) References Cited

U.S. PATENT DOCUMENTS

| | | | |
|---|---|---|---|
| 6,363,173 | B1 | 3/2002 | Stentz et al. |
| 6,363,632 | B1 | 4/2002 | Stentz et al. |
| 6,732,458 | B2 | 5/2004 | Kurenuma et al. |
| 7,181,370 | B2 | 2/2007 | Furem et al. |
| 7,406,399 | B2 | 7/2008 | Furem et al. |
| 7,574,821 | B2 | 8/2009 | Furem |
| 7,578,079 | B2 | 8/2009 | Furem |
| 7,726,048 | B2 | 6/2010 | Stanek et al. |
| 7,751,927 | B2 | 7/2010 | Pulli et al. |
| 7,752,779 | B2 | 7/2010 | Schoenmaker et al. |
| 7,832,126 | B2 | 11/2010 | Koellner et al. |
| 2008/0201108 | A1 | 8/2008 | Furem et al. |
| 2010/0010714 | A1 | 1/2010 | Claxton |
| 2010/0223008 | A1 | 9/2010 | Dunbabin et al. |

FOREIGN PATENT DOCUMENTS

| | | |
|---|---|---|
| WO | 0140824 | 6/2001 |
| WO | 2007057305 | 5/2007 |
| WO | 2009024405 | 2/2009 |

SYSTEMS, METHODS, AND DEVICES FOR CONTROLLING A MOVEMENT OF A DIPPER

BACKGROUND

This invention relates to controlling a movement of a dipper of an industrial machine, such as an electric rope shovel.

SUMMARY

Electric rope or power shovels and other industrial machines provide an operator with coarse operational controls for controlling the movement and position of, for example, a dipper throughout a work cycle. The work cycle includes four primary dipper motions: digging, swinging, dumping, and returning. The speed and efficiency with which the operator is able to execute these motions can impact the productivity of the shovel and a mine in general. However, when executing these motions and attempting to achieve a desired position within the work cycle (e.g., a desired dipper position for digging), coarse operational controls limit the operator's ability to achieve the desired position in the most efficient or optimal manner.

As such, the invention provides systems, methods, and devices for controlling a movement of a dipper such that an operator's desired position or trajectory for the dipper is used to automatically optimize the movement of the dipper. For example, the controller is configured to monitor parameters of the industrial machine with respect to the limits of a boom profile for the industrial machine. The monitored parameters include the position of the dipper, one or more output signals related to one or more operator input devices, characteristics of a hoist motor, and characteristics of a crowd motor. Based on these parameters, the controller can determine whether a calculated trajectory, or a desired future position, of the dipper will exceed the limits of the boom profile. The controller can then override the operator references from the one or more operator input devices and automatically control the dipper toward an alternative future position. When the dipper reaches the alternative future position or the operator references from the one or more operator input devices are appropriately modified (described below), automated control is suspended and direct control of the movement of the dipper is restored to the operator of the industrial machine.

In one embodiment, the invention provides an industrial machine that includes a dipper, a boom, a hoist motor, a crowd motor, one or more operator control devices, and a controller. The boom has a boom profile, and the boom profile includes a boom profile limit. The hoist motor has a hoist motor characteristic and is configured to receive control signals from a hoist drive module. The crowd motor has a crowd motor characteristic and is configured to receive control signals from a crowd drive module. The one or more operator control devices are configured to be manually controllable by an operator of the industrial machine. The controller is connected to the one or more operator control devices, the hoist drive module, and the crowd drive module. The controller is configured to receive one or more output signals associated with a desired movement of the dipper from the one or more operator control devices, receive one or more signals associated with the hoist motor characteristic, and receive one or more signals associated with the crowd motor characteristic. The controller is also configured to determine a present position of the dipper with respect to the boom profile, determine a first future position of the dipper with respect to the boom profile and based on the one or more output signals from the one or more operator control devices, the one or more signals associated with the hoist motor characteristic, and the one or more signals associated with the crowd motor characteristic, and automatically control a movement of the dipper with respect to the boom profile when the first future position of the dipper approximately corresponds to the boom profile limit.

In another embodiment, the invention provides a method of controlling an industrial machine. The industrial machine includes a dipper, a boom having a boom profile and a boom profile limit, a hoist motor having a hoist motor characteristic and configured to receive control signals from a hoist drive module, a crowd motor having a crowd motor characteristic and configured to receive control signals from a crowd drive module, one or more operator control devices configured to be manually controllable by an operator of the industrial machine, and a controller connected to the one or more operator control devices, the hoist drive module, and the crowd drive module. The method includes receiving one or more output signals associated with a desired movement of the dipper from the one or more operator control devices, receiving one or more signals associated with the hoist motor characteristic, and receiving one or more signals associated with the crowd motor characteristic. The method also includes determining a present position of the dipper with respect to the boom profile, determining a first future position of the dipper with respect to the boom profile and based on the one or more output signals from the one or more operator control devices, the one or more signals associated with the hoist motor characteristic, and the one or more signals associated with the crowd motor characteristic, and automatically controlling a movement of the dipper with respect to the boom profile when the determined future position of the dipper approximately corresponds to the boom profile limit.

In another embodiment, the invention provides a controller for an industrial machine. The controller includes an input/output module and a processing device. The input/output module is configured to receive an operator control signal associated with a desired movement of a dipper, receive a hoist motor characteristic signal, and receive a crowd motor characteristic signal. The processing device is configured to calculate a first future position of the dipper with respect to a shovel profile based on the operator control signal and a present position of the dipper, calculate a second future position of the dipper with respect to the shovel profile based on the present position of the dipper, the hoist motor characteristic signal, and the crowd motor characteristic signal, and generate a hoist drive signal for a hoist drive module and a crowd drive signal for a crowd drive module. The hoist drive signal and the crowd drive signal are associated with a movement of the dipper to the second future position when the first future position of the dipper approximately corresponds to a limit of the shovel profile.

Other aspects of the invention will become apparent by consideration of the detailed description and accompanying drawings.

DETAILED DESCRIPTION

Figure 1:
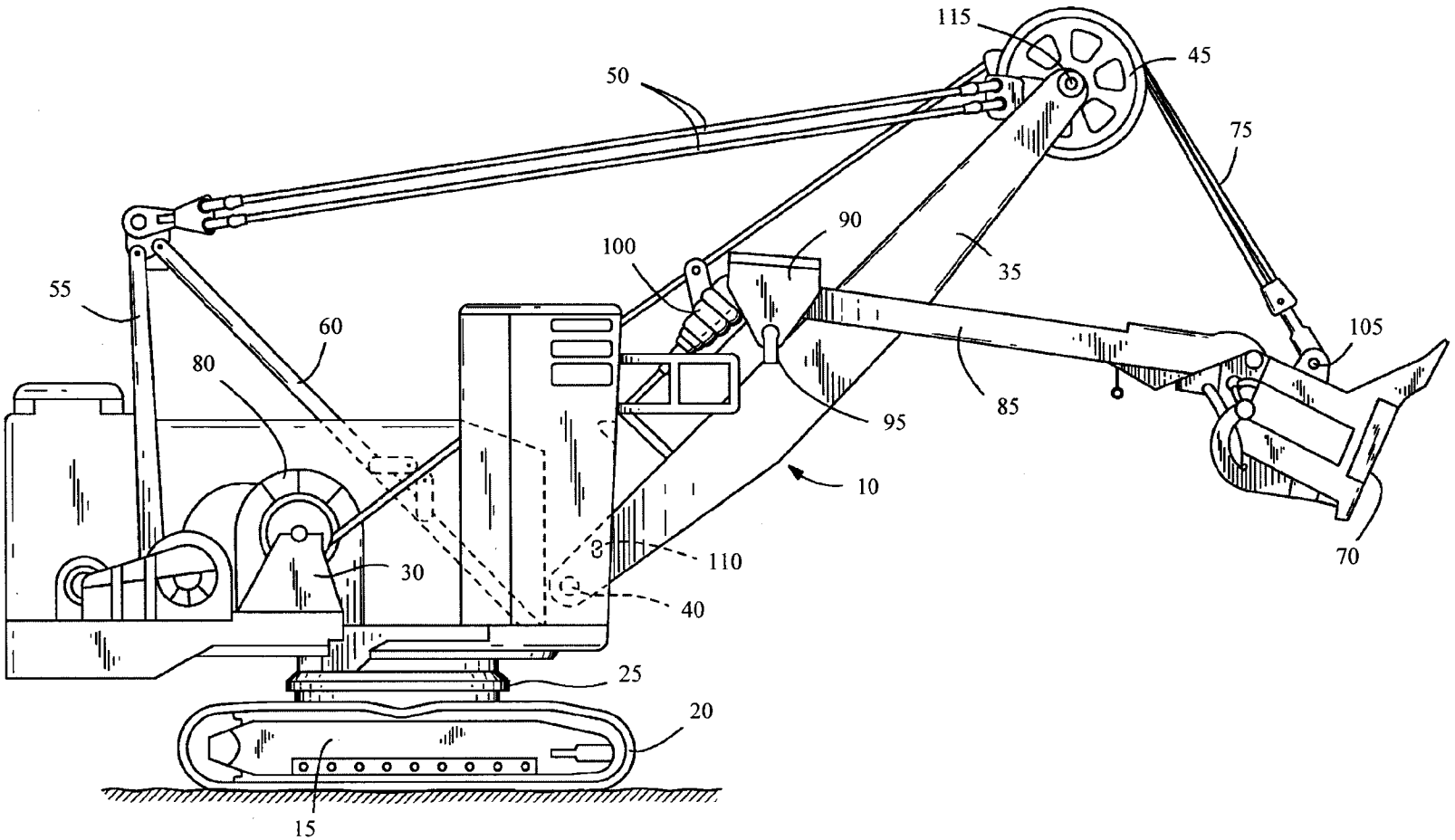
FIG. 1 illustrates an industrial machine according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should be noted that a plurality of hardware and software based devices, as well as a plurality of different structural components may be utilized to implement the invention. Furthermore, and as described in subsequent paragraphs, the specific configurations illustrated in the drawings are intended to exemplify embodiments of the invention and that other alternative configurations are possible. The terms "processor" "central processing unit" and "CPU" are interchangeable unless otherwise stated. Where the terms "processor" or "central processing unit" or "CPU" are used as identifying a unit performing specific functions, it should be understood that, unless otherwise stated, those functions can be carried out by a single processor, or multiple processors arranged in any form, including parallel processors, serial processors, tandem processors or cloud processing/cloud computing configurations.

The invention described herein relates to the control of an industrial machine (e.g., an electric rope or power shovel, a dragline, etc.). The industrial machine includes, among other things, a boom, a dipper, a hoist motor, a crowd motor, one or more operator input devices, and a controller. The one or more operator input devices are configured to control, for example, the position and movement of the dipper, an output of the hoist motor, and an output of the crowd motor throughout a work cycle of the industrial machine. When moving the dipper from one position to another (e.g., from a dumping position to a tuck position), the dipper often passes in close proximity to the boom, and the proximity of the dipper to the boom during such operations can adversely affect the operation and efficiency of the industrial machine. For example, as the dipper passes in proximity to various components of the industrial machine (e.g., the boom, drive tracks, a mobile base, etc.). For example, when passing in close proximity to the boom, the dipper may impact the boom if improper hoist and/or crowd controls are applied. Conversely, if the operator of the industrial machine is concerned with the potential for the dipper impacting the boom, the operator may move the dipper in a less efficient manner from the dumping position to the tuck position to avoid a collision. As such, the controller is configured to monitor parameters of the industrial machine, such as the position of the dipper, one or more electrical output signals associated with the one or more operator input devices, and characteristics of the hoist motor and the crowd motor with respect to limits of a boom profile of the industrial machine. If the controller determines that a calculated trajectory or desired future position of the dipper based on such parameters exceeds the limits of the boom profile, the controller overrides the operator references from the one or more operator input devices and automatically controls the dipper to an alternative future position. When the dipper reaches the alternative future position, or the operator references from the one or more operator input devices are appropriately modified (described below), automated control is suspended and direct control of the movement of the dipper is restored to the operator of the industrial machine.

Although the invention described herein can be applied to, performed by, or used in conjunction with a variety of industrial machines (e.g., an electric rope shovel, dragline, etc.), embodiments of the invention disclosed herein are described with respect to an electric rope or power shovel, such as the power shovel 10 shown in FIG. 1. The shovel 10 includes a mobile base 15, drive tracks 20, a turntable 25, a machinery deck 30, a boom 35, a lower end 40, a sheave 45, tension cables 50, a back stay 55, a stay structure 60, a dipper 70, a hoist rope 75, a winch drum 80, dipper arm or handle 85, a saddle block 90, a pivot point 95, a transmission unit 100, a bail pin 105, and an inclinometer 110.

The mobile base 15 is supported by the drive tracks 20. The mobile base 15 supports the turntable 25 and the machinery deck 30. The turntable 25 is capable of 360-degrees of rotation about the machinery deck 30 relative to the mobile base 15. The boom 35 is pivotally connected at the lower end 40 to the machinery deck 30. The boom 35 is held in an upwardly and outwardly extending relation to the deck by the tension cables 50 which are anchored to the back stay 55 of the stay structure 60. The stay structure 60 is rigidly mounted on the machinery deck 30, and the sheave 45 is rotatably mounted on the upper end of the boom 35.

The dipper 70 is suspended from the boom 35 by the hoist rope 75. The hoist rope 75 is wrapped over the sheave 45 and attached to the dipper 70 at the bail pin 105. The hoist rope 75 is anchored to the winch drum 80 of the machinery deck 30. As the winch drum 80 rotates, the hoist rope 75 is paid out to lower the dipper 70 or pulled in to raise the dipper 70. The dipper handle 85 is also rigidly attached to the dipper 70. The dipper handle 85 is slidably supported in a saddle block 90, and the saddle block 90 is pivotally mounted to the boom 35 at the pivot point 95. The dipper handle 85 includes a rack tooth formation thereon which engages a drive pinion mounted in the saddle block 90. The drive pinion is driven by an electric motor and transmission unit 100 to extend or retract the dipper arm 85 relative to the saddle block 90.

An electrical power source is mounted to the machinery deck 30 to provide power to oner more hoist electric motors for driving the winch drum 80, one or more crowd electric motors for driving the saddle block transmission unit 100, and one or more swing electric motors for turning the turntable 25. Each of the crowd, hoist, and swing motors are driven by its own motor controller or drive in response to control signals from a controller.

Figure 2:
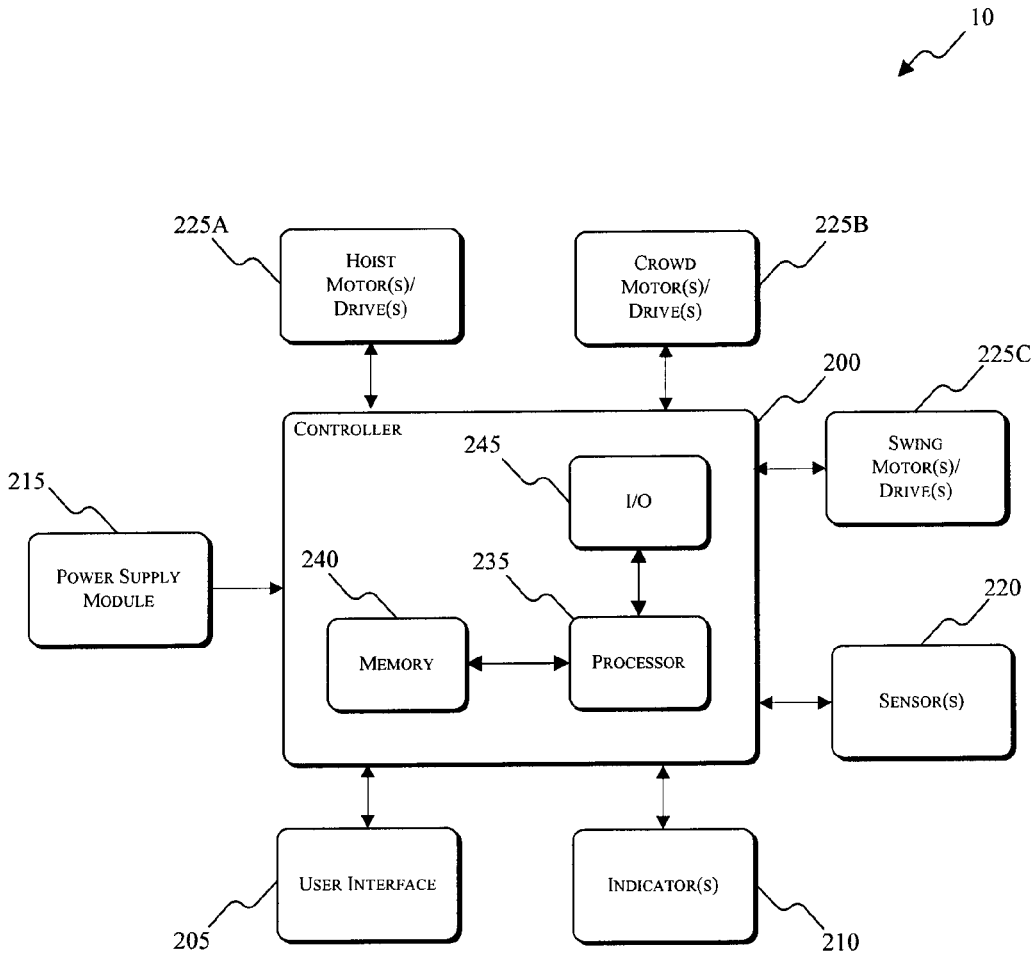
FIG. 2 illustrates a controller according to an embodiment of the invention.

FIG. 2 illustrates a controller 200 associated with the power shovel 10 of FIG. 1. The controller 200 is connected or coupled to a variety of additional modules or components, such as a user interface module 205, one or more indicators 210, a power supply module 215, one or more sensors 220, one or more hoist motors or hoist drive mechanisms 225A, one or more crowd motors or crowd drive mechanisms 225B, and one or more swing motors or swing drive mechanisms 225C. The one or more sensors 220 include, among other things, a loadpin strain gauge, the inclinometer 110, one or more motor field modules, etc. The loadpin strain gauge includes, for example, a bank of strain gauges positioned in an x-direction (e.g., horizontally) and a bank of strain gauges positioned in a y-direction (e.g., vertically) such that a resultant force on the loadpin can be determined. The controller 200 includes combinations of hardware and software that are operable to, among other things, control the operation of the power shovel 10, control the position of the boom 35, the dipper arm 85, the dipper 70, etc., activate the one or more indicators 210 (e.g., a liquid crystal display ["LCD"]), etc. The controller 200 includes, among other things, a processing unit 235 (e.g., a microprocessor, a microcontroller, or another suitable programmable device), a memory 240, and an input/output ("I/O") system 245. The processing unit 235, the memory 240, the I/O system 245, as well as the various modules connected to the controller 200 are connected by one or more control and/or data buses. The control and/or data buses are omitted from FIG. 2 for descriptive and clarity purposes. The use of one or more control and/or data buses for the interconnection between and communication among the various modules and components would be known to a person skilled in the art in view of the invention described herein.

The memory 240 includes, for example, a read-only memory ("ROM"), a random access memory ("RAM"), an electrically erasable programmable read-only memory ("EEPROM"), a flash memory, a hard disk, an SD card, or another suitable magnetic, optical, physical, or electronic memory device. The processing unit 235 is connected to the memory 240 and executes software that is capable of being stored in a RAM of the memory 240 (e.g., during execution), a ROM of the memory 240 (e.g., on a generally permanent basis), or another non-transitory computer readable medium such as another memory or a disc. Additionally or alternatively, the memory 240 is included in the processing unit 235. The I/O system 245 includes routines for transferring information between components within the controller 200 and other components of the power shovel 10 using the one or more control/data buses described above. Software included in the implementation of the power shovel 10 can be stored in the memory 240 of the controller 200. The software includes, for example, firmware, one or more applications, program data, one or more program modules, and other executable instructions. The controller 200 is configured to retrieve from memory and execute, among other things, instructions related to the control processes and methods described herein. In other constructions, the controller 200 includes additional, fewer, or different components. The power supply module 215 supplies a nominal AC or DC voltage to the components of the power shovel 10.

The user interface module 205 is used to control or monitor the power shovel 10. For example, the user interface module 205 is operably coupled to the controller 200 to control the position of the dipper 70, the transmission unit 100, the position of the boom 35, the position of the dipper handle 85, etc. The user interface module 205 can include a combination of digital and analog input or output devices required to achieve a desired level of control and monitoring for the power shovel 10. For example, the user interface module 205 can include a display and input devices such as a touch-screen display, one or more knobs, dials, switches, buttons, joysticks, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. In other constructions, the display is a Super active-matrix OLED ("AMOLED") display. The user interface module 205 can also be configured to display conditions or data associated with the power shovel 10 in real-time or substantially real-time. For example, the user interface module 205 is configured to display measured electrical characteristics of the power shovel 10, the status of the power shovel 10, the position of the dipper 70, the position of the dipper handle 85, etc. In some implementations, the user interface module 205 is controlled in conjunction with the one or more indicators 210 (e.g., LEDs, speakers, etc.) to provide visual or auditory indications of the status or conditions of the power shovel 10.

Figure 3:
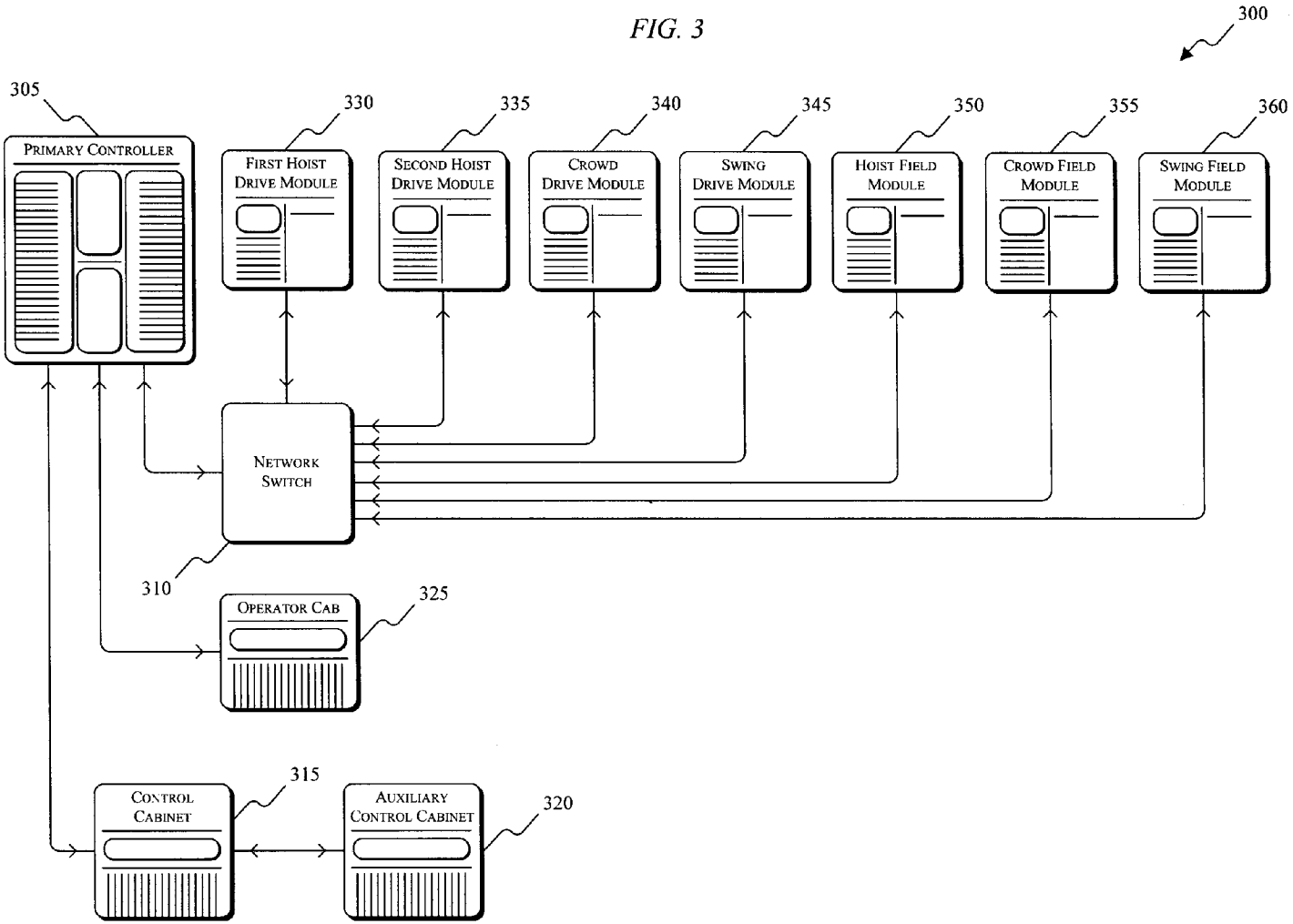
FIG. 3 illustrates a control system for an industrial machine according to an embodiment of the invention.

FIG. 3 illustrates a more detailed control system 300 for the power shovel 10. For example, the power shovel 10 includes a primary controller 305, a network switch 310, a control cabinet 315, an auxiliary control cabinet 320, an operator cab 325, a first hoist drive module 330, a second hoist drive module 335, a crowd drive module 340, a swing drive module 345, a hoist field module 350, a crowd field module 355, and a swing field module 360. The various components of the control system 300 are connected by and communicate through, for example, a fiber-optic communication system utilizing one or more network protocols for industrial automation, such as process field bus ("PROFIBUS"), Ethernet, ControlNet, Foundation Fieldbus, INTERBUS, controller-area network ("CAN") bus, etc. The control system 300 can include the components and modules described above with respect to FIG. 2. For example, the motor drives 225A-225C can correspond to the hoist, crowd, and swing drives 330, 335, 340, and 345, the user interface 205 and the indicators 210 can be included in the operator cab 325, etc. The loadpin strain gauge and inclinometer 110 can provide electrical signals to the primary controller 305, the controller cabinet 315, the auxiliary cabinet 320, etc.

The first hoist drive module 330, the second hoist drive module 335, the crowd drive module 340, and the swing drive module 345 are configured to receive control signals from, for example, the primary controller 305 to control hoisting, crowding, and swinging operations of the shovel 10. The control signals are associated with drive signals for hoist, crowd, and swing motors 225A, 225B, and 225C of the shovel 10. As the drive signals are applied to the motors 225A, 225B, and 225C, the outputs (e.g., electrical and mechanical outputs) of the motors are monitored and fed back to the primary controller 305 (e.g., via the field modules 350-360). The outputs of the motors include, for example, motor speed, motor torque, motor power, motor current, etc. Based on these and other signals associated with the shovel 10 (e.g., signals from the inclinometer 110), the primary controller 305 is configured to determine or calculate one or more operational states or positions of the shovel 10 or its components. In some embodiments, the primary controller 305 determines a dipper position, a hoist wrap angle, a hoist motor rotations per minute ("RPM"), a crowd motor RPM, a dipper speed, a dipper acceleration, etc.

The shovel 10 described above is configured to execute a work cycle that includes, for example, four dipper motions: digging, swinging, dumping, and returning. The shovel 10 is also capable of propulsion from one position to another (e.g., one digging position to another). During the work cycle, the shovel 10 is controlled to, among other things, impact a bank, fill the dipper, swing the filled dipper, empty the dipper, and return the emptied dipper to a tuck position for a subsequent digging operation. During such motions, the dipper must be controlled within the operation limits of the shovel 10. For example, during the returning operation, the dipper 70 often comes in close proximity to the boom 35 based on the relative application of hoist and crowd forces from the hoist and crowd motors 225A and 225B, respectively. During such an operation, it is possible for the dipper 70 to impact the boom 35, which can result in damage to the boom 35, the dipper 70, or other components of the shovel 10. In addition to the dangers of potentially impacting the boom 35, the operator's ability to control the position of the dipper 70 (i.e., using hoist and crowd controls) is inhibited by coarse controls having a limited degree of precision. Imprecise control of the movement of the dipper 70 during, for example, the returning operation can adversely affect the efficiency of the shovel 10 and a mine as a whole. Additionally, although the invention is described herein with respect to a boom profile and limits of the boom profile, the movement of the dipper 70 can also be controlled with respect to additional or different components (e.g., the mobile base 15, the drive tracks 20, etc.) and corresponding shovel profiles. In such embodiments, the geometry and limits of these components can be programmed into the controller 200, and the dipper 70 can be correspondingly controlled with respect to them. In some embodiments, the movement of the dipper can also be controlled with respect to environmental profiles such as a ground profile, a bank profile, or another machine profile within the working environment of the shovel 10 (e.g., a truck, a hopper, etc.). In such embodiments, one or more sensors or systems (e.g., laser, sonic, infrared, geo-location, global positioning, etc.) are mounted to or included in the shovel 10 for determining the location of the shovel 10 or the dipper 70 with respect to the environmental profiles.

Figure 4:
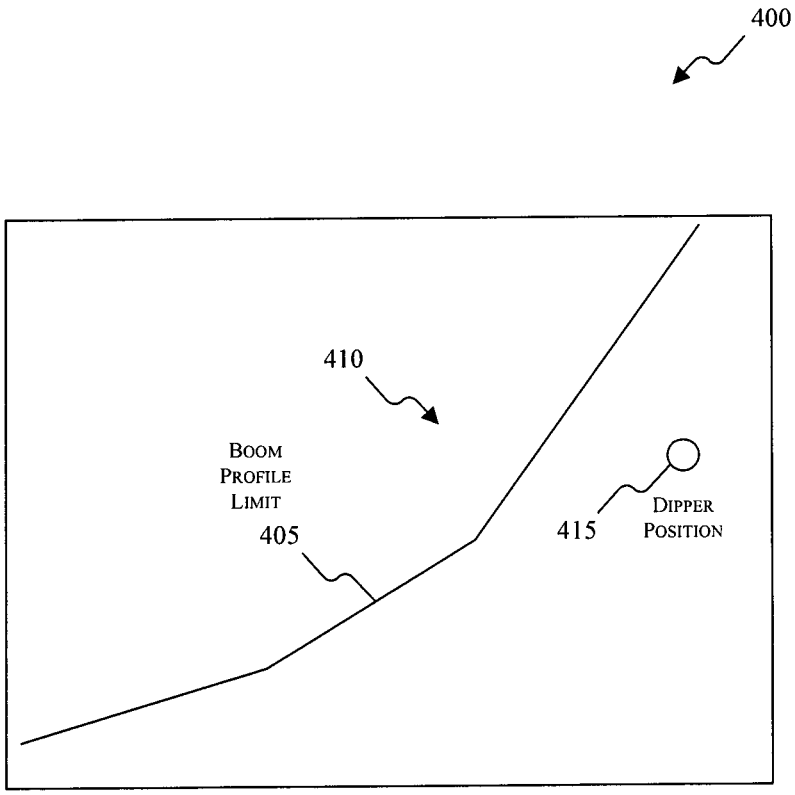
FIG. 4 is a diagram illustrating a boom profile with respect to a dipper position.

As such, the controller 200 or the primary controller 305 is configured to precisely control of the movement of the dipper 70 from a dumping position to a tuck position with respect to a boom profile, and to efficiently position the dipper 70 in a repeatable and ideal tuck position for a subsequent digging operation. FIG. 4 is a diagram 400 that illustrates the limits 405 of a boom profile 410 with respect to the position 415 of the dipper 70. The position 415 of the dipper 70 can be determined as described above based on signals from, for example, the hoist motor or drive 225A, the crowd motor or drive 225B, the loadpin assembly, the inclinometer 110, etc. The boom profile and the limits of the boom profile can be programmed into the controller 200 or the primary controller 305 based on, among other things, physical dimensions of the boom and the shovel 10, the size of an installed dipper, hoist motor characteristics, crowd motor characteristics, etc.

When controlling the shovel 10 to move the dipper 70 from one position to another, the movement of the dipper 70 is typically manually controlled by an operator using one or more control devices (e.g., joysticks) associated with the operator cab 325. The control devices generate signals which are received and interpreted by the primary controller 305 before corresponding drive or control signals are generated and sent to the hoist, crowd, and swing drive modules 330, 335, 340, and 345. Based on these drive signals, the hoist, crowd, and swing motors 225A, 225B, and 225C cause a movement of the dipper 70. However, as described above, the operator's shovel controls are often imprecise and can result in the inefficient operation of the shovel 10. For example, after depositing a load of material in a pile or a truck, the operator may swing the dipper 70 from the dumping position while simultaneously lowering the dipper 70 by controlling the hoist motor 225A and tucking the dipper 70 by controlling the crowd motor 225B.

More precise and efficient control of the movement of the dipper can be achieved using a combination of manual controls (i.e., using the one or more operator control devices) and real-time automated control of the shovel 10 based on the corresponding signals generated by the one or more operator control devices. For example, the controller 200 or the primary controller 305 monitors the signals from the one or more operator control devices, signals from the hoist motor 225A, the crowd motor 225B, and the swing motor 225C, the inclinometer 110, the loadpin, etc., to determine or calculate the operator's desired future position for the dipper 70. If the operator's desired future position of the dipper 70 is determined or calculated to exceed the limits of the boom profile or to pass too closely (i.e., within, a predetermined distance of) the limits of the boom profile, an automated retract control ("ARC") system or module (e.g., combinations of hardware and software) within the controller 200 or the primary controller 305 is initiated to automatically control the tucking of the dipper 70.

In some embodiments, additional criteria can be used to determine when the shovel 10 is executing a returning or tucking operation. For example, following the emptying of the dipper 70 into a truck or onto a pile, a load weighing system or mechanism can be used to determine a change in the weight of a payload. Additionally or alternatively, a sensor or switch associated with releasing the dipper door to empty the dipper 70 is used as an indication that a returning or tucking operation may be subsequently initiated. The additional criteria can also include characteristics of the swing motor 225A, the swing drive module 345, or one or more operator controlled swing control devices (e.g., joysticks). Accordingly, signals associated with the recent emptying of the dipper 70, the swinging of the dipper 70, and the manually operated hoist and crowd controls can be used to initiate ARC. An illustrative example of ARC is provided below with respect to FIGS. 5 and 6.

Figure 5:
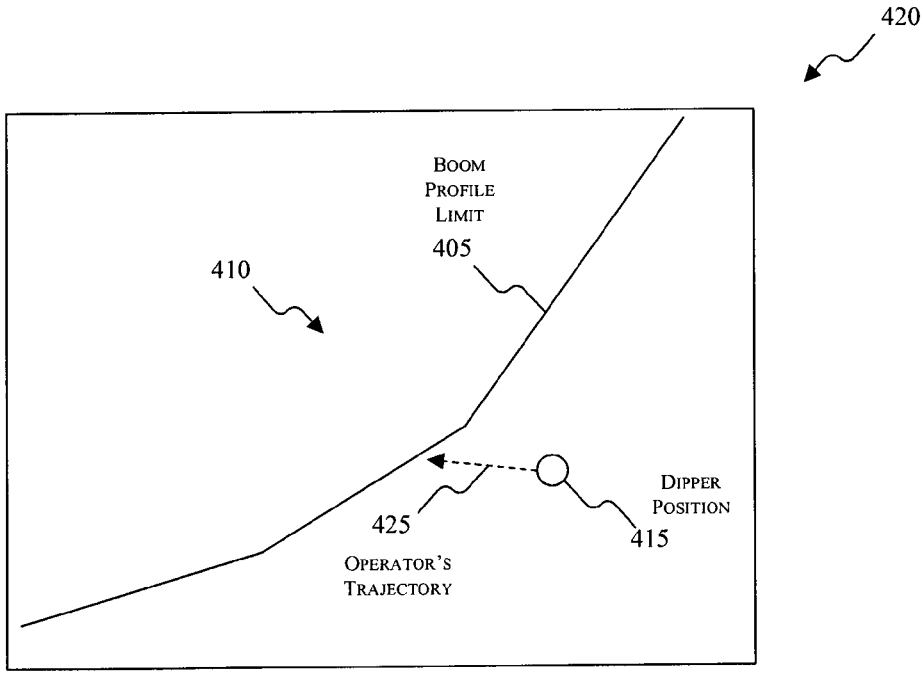
FIG. 5 is a diagram illustrating a boom profile and a movement of a dipper.

FIG. 5 is a diagram 420 showing the limits 405 of the boom profile 410 with respect to the position of the dipper 70, and a desired trajectory 425 of the dipper 70 based on the operator references (e.g., signals from or based on the one or more operator control devices). In FIG. 5, the trajectory 425 of the dipper 70 based on the manual operator references illustrates that the position 415 of the dipper 70 will rapidly approach the limits 405 of the boom profile 410. In such an instance, the ARC system or module overrides the operator references to automatically control the movement of the dipper 70. The automated control of the dipper 70 avoids a collision with the boom 35 and ensures that the dipper 70 reaches an alternative future position (e.g., an ideal tuck position) as quickly and efficiently as possible.

Figure 6:
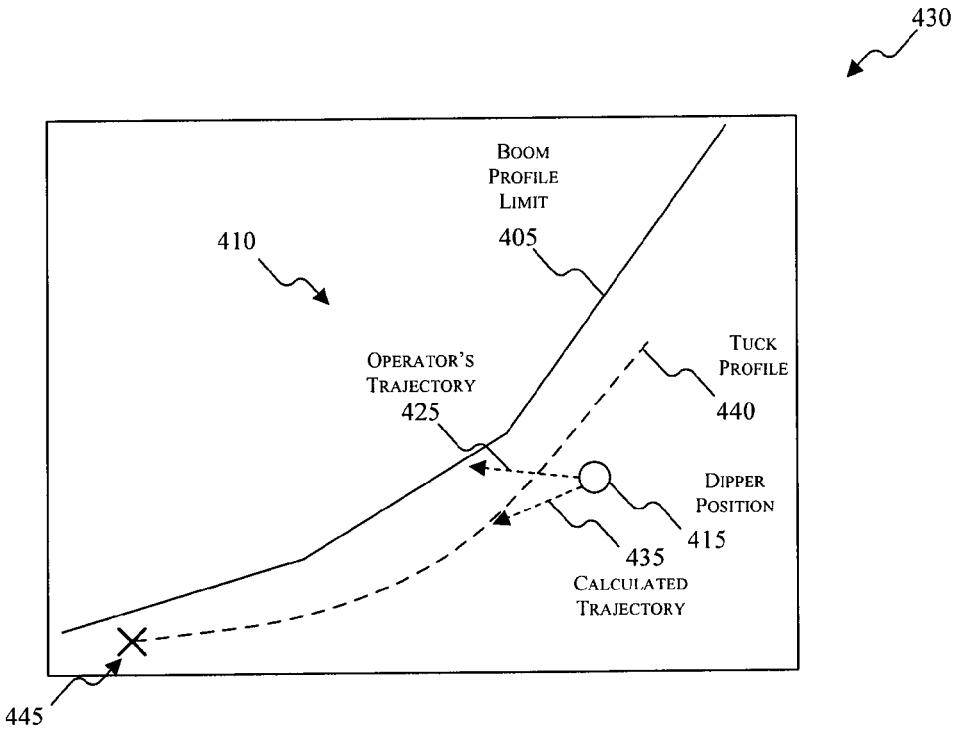
FIG. 6 is a diagram illustrating a boom profile, a movement of a dipper, and a tuck profile according to an embodiment of the invention.

For example, FIG. 6 illustrates the control of the ARC system or module. The trajectory 425 of the dipper 70 based on the manual operator references would cause the dipper 70 to impact or collide with the boom 35. After such a condition is detected, the ARC system or module overrides the operator references, monitors the boom profile 400, and calculates maximum levels of hoist and crowd that cause the movement of the dipper 70 along a determined or calculated trajectory 435 to follow a tuck profile 440. The tuck profile 440 corresponds to a trajectory of the dipper 70 that will prevent the dipper 70 from impacting the boom 35 while maximizing the speed at which the dipper 70 reaches an alternative future position 445.

In some embodiments, the automated control of the movement of the dipper 70 can be discontinued manually by the operator. For example, modifying the hoist and crowd controls such that the dipper's trajectory no longer exceeds the limits 405 of the boom profile 410 can disable the automated control. As such, control of the movement of the dipper 70 by the ARC system or module can be initiated, for example, intentionally by applying maximum hoist and/or crowd control signals (i.e., which would cause the dipper 70 to exceed the limits 405 of the boom profile 410), or unintentionally when the operator's controls are determined or calculated to exceed the limits 405 of the boom profile 410 or pass too closely to the limits 405 of the boom profile 410. Since the ARC system or module is operated in real-time, or substantially real-time, the automated control can be initiated and suspended based on the manual operator controls without requiring the operator to activate or initiate a programmed shovel or dipper movement (e.g., activating a dedicated button to relinquish control of the movement of the shovel 10 or dipper 70 until the completion of the programmed movement).

Figure 7:
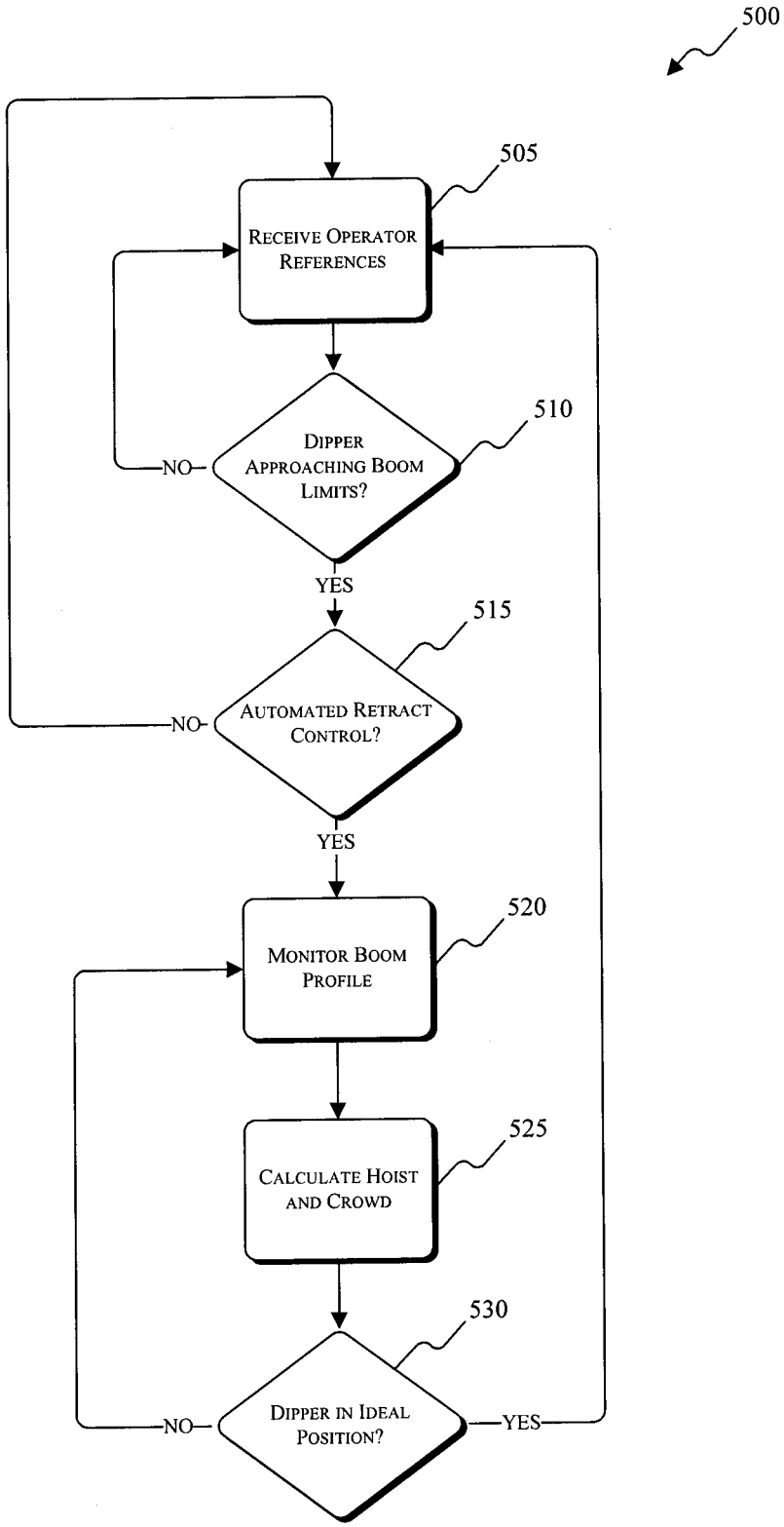
FIG. 7 is a process for controlling a movement of a dipper according to an embodiment of the invention.

FIG. 7 is a process 500 for controlling the movement of a dipper 70 as described above. The process 500 begins when a set of operator references are received (step 505). The operator references include, for example, relative or absolute values associated with hoist, crowd, and swing motions (e.g., joystick control inputs), etc. In some embodiments, the set of operator references correspond to only those controls related to the movement of the dipper 70. In other embodiments, the operator references correspond to all operator control inputs, or one or more subsets of all of the operator control inputs. As described above, the operator references are processed by, for example, the controller 200 or the primary controller 305. The process 500 is described herein with respect to the primary controller 305. Prior to the generation of control or drive signals for the hoist, crowd, and swing control modules 330-345, the primary controller 305 is configured to determine or calculate, based on the operator references, whether the desired motion of the dipper 70 will approach, exceed, or otherwise approximately correspond to the limits of the boom profile (step 510). If the desired movement of the dipper 70 does not result in the dipper 70's position approaching or exceeding the limits of the boom profile, the process 500 returns to step 505 and additional operator references are received and processed. If the desired movement of the dipper 70 is determined or calculated to approach or exceed the limits of the boom profile, the primary controller 305 determines whether automated control by the ARC system or module should be initiated (step 515). If ARC is not to be initiated, the process 500 returns to step 505 and additional operator references are received and processed. If ARC is to be initiated, the process 500 proceeds to step 520.

The determination of whether ARC is to be initiated is based on, among other things, the current position of the dipper 70, the determined or calculated future position of the dipper 70, and the boom profile. When the primary controller 305 determines or calculates that the operator references correspond to a dipper movement or position approximately corresponding to or exceeding the limits of the boom profile, the operator references are ignored or discarded and the ARC system or module takes over control of the movement of the dipper 70. After assuming control of the movement of the dipper, the ARC system or module monitors the boom profile (step 520). Based in part on the current position of the dipper 70, the ARC system or module identifies the boom profile ahead of the current dipper position based on current control signals (e.g., hoist motor RPM, crowd motor RPM, etc.). The control signals and operator references are assumed to remain the same for the purpose of comparison with the boom profile. If the ARC system or module determines that the dipper 70 may exceed the limits of the boom profile or the dipper 70 may substantially correspond to the limits of the boom profile, the ARC system or module identifies when such an event will occur and calculates an alternative future dipper position to which the dipper 70 will be moved. In some embodiments, the alternative dipper position is an ideal tuck position for beginning a new digging cycle. In other embodiments, the alternative dipper position is an intermediate location along the tuck profile 440 shown in FIG. 6. In such embodiments, ARC can be used to prevent the movement of the dipper 70 from exceeding or substantially corresponding to the limits of the boom profile, but returns control to the operator once the potential event has been avoided. Once the alternative position of the dipper 70 has been calculated, the ARC system or module calculates the operator references needed to ensure that appropriate hoist and crowd drive signals (e.g., maximum hoist and crowd drive signals) are applied to the hoist and crowd motors 225A and 225B, respectively, to achieve the alternative future position (step 525). In some embodiments, the amount or level of hoist required to achieve the alternative future position is determined or calculated based on the possibility that a determined or calculated amount or level of crowding is unable to be achieved given the limits within which the crowd motor 225B operates (e.g., a maximum speed). If the crowd motor 225B is unable to produce the speed necessary to achieve the alternative future position in an appropriate amount of time (e.g., to avoid a collision), the amount or level of hoist can be reduced to allow the crowd motor to be operated within operational limits and achieve the alternative future position.

Following step 525, the ARC system or module monitors the position of the dipper 70 to determine whether the dipper 70 has reached the alternative future position (e.g., the ideal tuck position to begin a subsequent digging cycle) (step 530). If the dipper 70 has not reached the alternative future position, the boom profiled continues to be monitored at step 520. If the dipper 70 has reached the alternative future position, the ARC system or module relinquishes control of the movement of the dipper 70, and the operator references are again used to control the movement of the dipper 70. The process 500 then returns to step 505 where the operator references are received and processed to determine whether the dipper 70 is again approaching the limits of the boom profile.

Thus, the invention provides, among other things, systems, methods, and devices for automatically controlling an industrial machine based on manual operator inputs. Various features and advantages of the invention are set forth in the following claims.

What is claimed is:

1. An industrial machine comprising:

a dipper;

a boom having a boom profile, the boom profile including a boom profile limit;

a hoist motor having a hoist motor characteristic and configured to receive control signals from a hoist drive module;

a crowd motor having a crowd motor characteristic and configured to receive control signals from a crowd drive module;

one or more operator control devices configured to be manually controllable by an operator of the industrial machine;

a controller connected to the one or more control devices, the hoist drive module, and the crowd drive module, the controller configured to receive one or more output signals associated with a desired movement of the dipper from the one or more operator control devices, receive one or more signals associated with the hoist motor characteristic, receive one or more signals associated with the crowd motor characteristic, determine a present position of the dipper with respect to the boom profile, determine a first future position of the dipper with respect to the boom profile and based on the one or more output signals from the one or more operator control devices, the one or more signals associated with the hoist motor characteristic, and one or more signals associated with the crowd motor characteristic, and automatically control a movement of the dipper with respect to the boom profile when the first future position of the dipper approximately corresponds to the boom profile limit.

2. The industrial machine of claim 1, wherein the hoist motor characteristic is a rotations per minute ("RPM") of the hoist motor, and the crowd motor characteristic is an RPM of the crowd motor.

3. The industrial machine of claim 1, wherein the controller is further configured to override the one or more output signals from the one or more operator control devices when the determined future position of the dipper approximately corresponds to the boom profile limit.

4. The industrial machine of claim 1, wherein the controller is further configured to determine a second future position based on the boom profile and the present position of the dipper.

5. The industrial machine of claim 4, wherein the controller is further configured to automatically control the movement of the dipper to the second future position.

6. The industrial machine of claim 5, wherein the automatic control of the dipper with respect to the boom profile is suspended when the dipper reaches the second future position.

7. The industrial machine of claim 5, wherein the second future position is different than the first future position.

8. The industrial machine of claim 7, wherein the second future position of the dipper corresponds to a tuck position associated with a beginning of a digging cycle of the industrial machine.

9. A method of controlling an industrial machine, the industrial machine including a dipper, a boom having a boom profile and a boom profile limit, a hoist motor having a hoist motor characteristic and configured to receive control signals from a hoist drive module, a crowd motor having a crowd motor characteristic and configured to receive control signals from a crowd drive module, one or more operator control devices configured to be manually controllable by an operator of the industrial machine, and a controller connected to the one or more operator control devices, the hoist drive module, and the crowd drive module, the method comprising:

receiving one or more output signals associated with a desired movement of the dipper from the one or more operator control devices;

receiving one or more signals associated with the hoist motor characteristic;

receiving one or more signals associated with the crowd motor characteristic;

determining a present position of the dipper with respect to the boom profile;

determining a first future position of the dipper with respect to the boom profile and based on the one or more output signals from the one or more operator control devices, one or more signals associated with the hoist motor characteristic, and the one or more signals associated with the crowd motor characteristic; and automatically controlling a movement of the dipper with respect to the boom profile when the determined future position of the dipper approximately corresponds to the boom profile limit.

10. The method of claim 9, wherein the hoist motor characteristic is a rotations per minute ("RPM") of the hoist motor, and the crowd motor characteristic is an RPM of the crowd motor.

11. The method of claim 9, further comprising overriding the one or more output signals from the one or more operator control devices when the first future position of the dipper approximately corresponds to the boom profile limit.

12. The method of claim 9, further comprising determining a second future position based on the boom profile and the present position of the dipper.

13. The method of claim 12, further comprising automatically controlling the movement of the dipper to the second future position.

14. The method of claim 13, wherein the automatic control of the dipper with respect to the boom profile is suspended when the dipper reaches the second future position.

15. The method of claim 13, wherein the second future position of the dipper is different than the first future position of the dipper.

16. The method of claim 15, wherein the second future position of the dipper corresponds to a tuck position associated with a beginning of a digging cycle of the industrial machine.

* * * * *